United States Patent [19]

Nilsson et al.

[11] Patent Number: 4,946,085

[45] Date of Patent: Aug. 7, 1990

[54] APPARATUS FOR PRODUCING PAPER WITH DECORATIVE EDGES

[75] Inventors: Ingvar Nilsson, Akarp, Sweden; William H. Gunther, Jr., Mystic, Conn.

[73] Assignee: Svecia Antiqua Limited, Kent, England

[21] Appl. No.: 20,448

[22] Filed: Mar. 2, 1987

[51] Int. Cl.[5] ..... B26F 3/02; B26D 9/00

[52] U.S. Cl. ..... 225/3; 225/97; 83/420; 83/422; 271/272; 493/328; 493/467

[58] Field of Search ..... 493/365, 367, 370, 328, 493/467; 162/361, 362, 286; 225/97, 3, 96, 98, 99; 83/498, 504, 506, 507, 508.3, 479, 500, 420, 422; 271/253–255, 272

[56] References Cited

U.S. PATENT DOCUMENTS

| | | | |
|---|---|---|---|
| 244,845 | 7/1881 | Bowles | 83/430 |
| 301,178 | 7/1884 | Stonemetz | 493/370 |
| 641,798 | 1/1900 | Reynolds . | |
| 1,161,747 | 11/1915 | Stamets . | |
| 1,291,931 | 1/1919 | Kornas | 83/422 |
| 1,616,211 | 2/1927 | Armstrong . | |
| 1,638,298 | 8/1927 | Flood et al. | 493/328 |
| 1,761,051 | 6/1930 | Rivard | 162/194 |
| 1,810,316 | 6/1931 | Lamory . | |
| 1,846,094 | 2/1932 | Dodge | 493/370 |
| 2,026,754 | 1/1936 | Stafford | 225/3 |
| 2,729,136 | 1/1956 | Feick et al. | 271/254 |
| 3,239,116 | 3/1966 | Hulak | 225/3 |
| 3,377,008 | 4/1968 | Sutton | 271/255 |
| 3,722,336 | 3/1973 | Sarring | 83/421 |
| 4,069,011 | 1/1978 | Gunther, Jr. | 432/230 |
| 4,071,997 | 2/1978 | Gunther, Jr. et al. | 53/31 |
| 4,082,603 | 4/1978 | McPherson et al. | 156/654 |
| 4,106,432 | 8/1878 | Gunther, Jr. | 118/211 |
| 4,168,643 | 9/1979 | Takimoto et al. | 83/430 |
| 4,189,341 | 2/1980 | McPherson et al. | 156/654 |
| 4,233,931 | 11/1980 | Gingerich et al. | 271/272 |
| 4,299,073 | 11/1981 | Golicz et al. | 53/493 |
| 4,312,169 | 1/1982 | Golicz et al. | 53/206 |
| 4,343,129 | 8/1982 | Gunther, Jr. et al. | 53/206 |
| 4,464,878 | 8/1984 | Golicz et al. | 53/206 |
| 4,601,692 | 7/1986 | Rausing et al. | 83/651.1 |
| 4,669,644 | 6/1987 | Nilsson | 225/3 |
| 4,710,158 | 12/1987 | Knipp et al. | 225/99 |

*Primary Examiner*—Douglas D. Watts
*Assistant Examiner*—Rinaldi Rada
*Attorney, Agent, or Firm*—Weiser & Stapler

[57] ABSTRACT

A deckle-edge-simulating apparatus generally comprising a conveyor system for transporting a web of paper through the apparatus, and a novel deckle-edge-simulating assembly operatively associated with the conveyor system. The deckle-edge-simulating assembly generally includes a configured transport roller or anvil in association with a deckling fixture. The anvil is disposed beneath the web of paper, and includes one or more circumferential grooves in its surface. The deckling fixture includes a blunt-edged blade extending from and between a pair of nip forming rollers disposed on either side of the blade, and into one of the grooves of an anvil. As the web of paper passes across the anvil, the blunt-edged blade operates to burst the fibers of the paper to create a simulated deckled edge. The nip forming rollers serve to firmly hold the web of paper in position during this deckling procedure.

33 Claims, 6 Drawing Sheets

APPARATUS FOR PRODUCING PAPER WITH DECORATIVE EDGES

BACKGROUND OF THE INVENTION

The present invention relates generally to the manufacture of paper with decorative edges, and in particular, to automated means for producing a so-called deckle-edged paper.

In the manufacture of hand made paper, conventional practice is to form individual sheets of paper in a wooden frame or the like. Upon separation of the frame for removal of the hand made sheet, it is conventional for the edges of the resulting sheet to take on an irregular or feathered appearance resulting from the manner in which the edges were retained between the sections of the paper-making frame. In addition to serving to identify hand made papers, which are very expensive, these feathered edges tend to provide an elegant finish. Consequently, efforts have been made to develop means for simulating such deckled edges in milled papers, to provide such papers with the appearance of a hand made paper, preferably in an automated process.

For example, U.S. Pat. No. 4,601,692 describes an apparatus which operates to withdraw a web of milled paper from a continuous roll, for transport through the apparatus so that edges of the web are drawn across a pair of deckle-edge-simulating elements. Each of these elements includes a roller disposed transverse to, and beneath the web of paper as it is transported through the apparatus, and a tearing wire which crosses the plane of the paper and which is received within a groove provided in the transport roller. As a consequence of this construction, as the web of paper is drawn through the apparatus, the web is caused o encounter the tearing wire so that the paper is torn as the wire cuts across the plane of the paper, simulating a deckled edge.

British Patent No. 2,171,629 also describes an apparatus for simulating a deckled edge in a continuous web of paper. The described apparatus includes a conveyor for receiving the web of paper, and a contiguous tearing belt disposed about a series of pulleys so that the tearing belt is initially caused to progress parallel with the conveyor, and so that the tearing belt is thereafter caused to proceed downwardly through the plane of the web of paper. As a consequence of this construction, as the web of paper is drawn through the apparatus, the web is initially received between the parallel conveyor and tearing belt, until the web reaches the deflection point for the tearing belt. At this point, the edges of the web are drawn across the edges of the conveyor to develop a simulated deckled edge.

While each of these devices have found success in simulating a deckled edge in a continuous web of milled paper, such devices have generally required constant and careful adjustment to maintain the quality of the deckled edge being simulated. Otherwise, the quality of the deckled edge would tend to vary throughout the manufacturing process, at times unacceptably.

Moreover, recent advances in automated mailing procedures and devices have created a particular interest in the development of an automated apparatus for simulating a deckle-edged paper, not only for the contents to be mailed, but also on selected edges of the envelopes used to mail them. However, in attempting to produce sheets and blanks of this nature using available deckle-edge-simulating equipment, it was found that suitable results could not be obtained without requiring either a significant compromise in production rate, or continuous and careful adjustment of the deckle-edge-simulating apparatus.

SUMMARY OF THE INVENTION

It is therefore a primary object of the present invention to provide an apparatus for simulating a deckled edge on a sheet of paper in automated fashion.

It is also an object of the present invention to provide a deckle-edge-simulating apparatus which is capable of operating upon continuous webs of paper, as well as discrete sheets.

It is also an object of the present invention to provide a deckle-edge-simulating apparatus which is capable of operating in automated fashion with a minimal amount of care and adjustment, and without compromising production rates.

It is also an object of the present invention to provide a deckle-edge-simulating apparatus which is capable of simulating a deckled edge on sheets of paper, an on cut blanks which may be used to develop mailing envelopes.

These and other objects are achieved according to the present invention by carrying out the edge-deckling process with a deckle-edge-simulating apparatus which generally comprises a conveyor system for transporting a web of paper (which is generally segmented) through the apparatus, and a novel deckle-edge-simulating assembly operatively associated with the conveyor system. The deckle-edge-simulating assembly generally includes a configured transport roller or anvil in association with a decking fixture. The anvil is disposed in transverse relation to the web of paper which is being processed through the apparatus, beneath the web of paper, and includes one or more circumferential grooves positioned at spaced locations along its surface. The associated deckling fixture includes a blunt-edged blade extending from and between a pair of rollers disposed on either side of the blade so as to develop a pair of paper engaging nips on either side of the blunt-edged blade and the groove of the anvil which receives it. As the web of paper passes across the anvil, the blunt-edged blade operates to burst the fibers of the paper to create a simulated deckled edge. The nip forming rollers serve to firmly hold the web of paper in position during this deckling procedure to assure regular results with a minimum of care and adjustment.

Such an apparatus serves to facilitate the edge-deckling process, reducing overall manufacturing costs while maintaining the quality of the resulting product. Such improvements result not only when using standard papers, but also when using prestige papers (e.g., Svecia Antiqua Rare or the like), both with and without watermarks. For further detail regarding a preferred embodiment deckle-edge-simulating apparatus according to the present invention, reference is made to the detailed description which follows, taken in conjunction with the following illustrations.

BRIEF DESCRIPTION OF THE DRAWINGS

In the several views provided, like reference numerals denote similar structure.

DETAILED DESCRIPTION OF A PREFERRED EMBODIMENT

Figure 1:
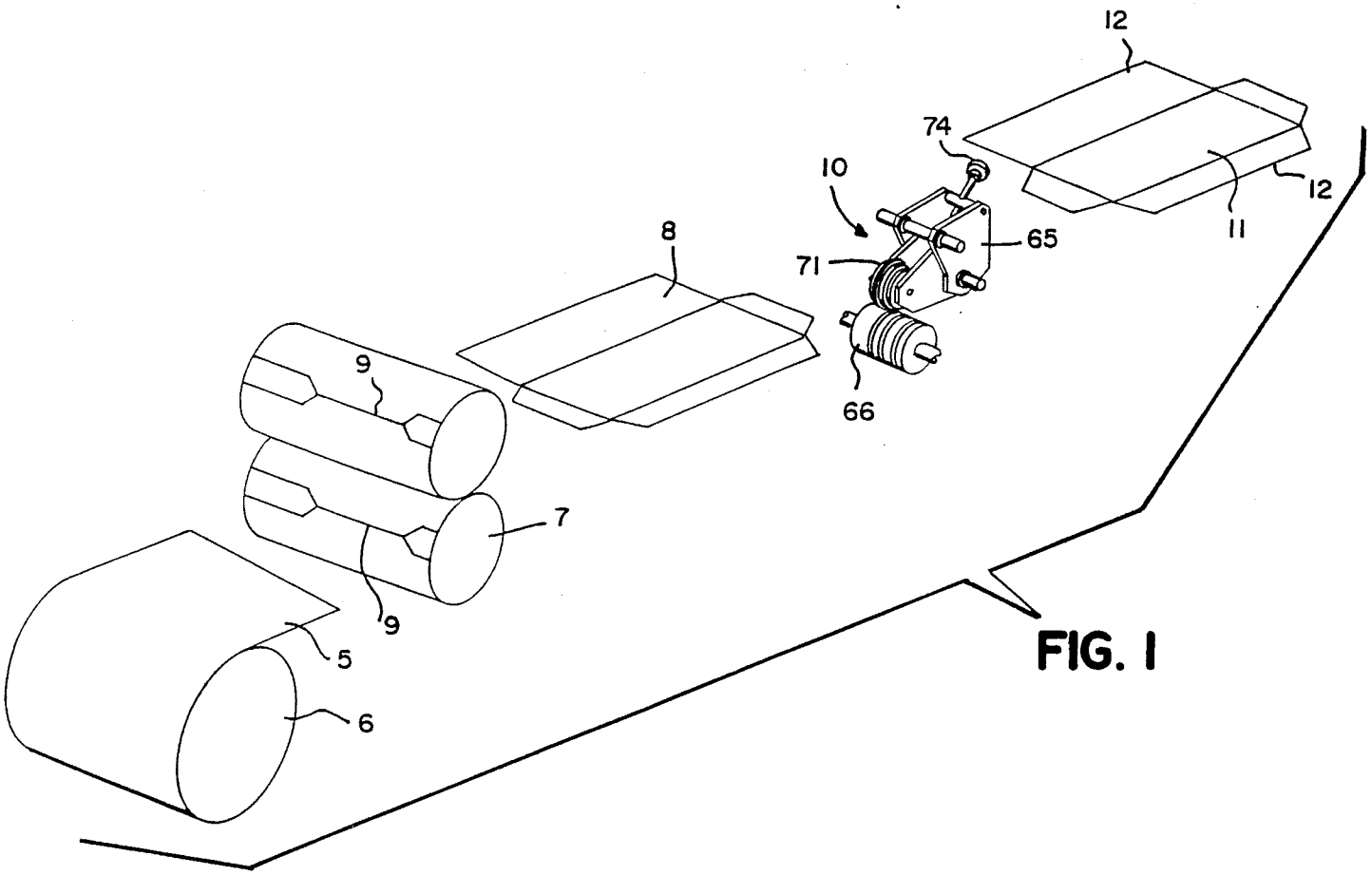
FIG. 1 is an isometric view which schematically illustrates the deckle-edge-simulating process of the present invention.

FIG. 1 generally illustrates the technique which is used to provide a simulated deckled edge according to the present invention. To this end, a continuous web 5 of milled paper (conventional or prestige) is withdrawn from a roll 6 for introduction to elements of the paper processing apparatus which follow. To be noted is that this web of paper may either be blank, or preprinted, depending upon the nature of the operation involved. The web 5 is first introduced to a sheet cutting device, in this case an opposed pair of rollers 7, for cutting the continuous web 5 into discrete segments 8. To be noted is that other types of sheet cutting devices may be used to accomplish similar results, such as guillotine cutters and the like. Also to be noted is that by properly configuring the blades 9 of the rollers 7, such a device may be used to create either individual sheets of paper, or configured sheets of paper such as the blank shown in the illustration, which may be used for various purposes such as developing an envelope in an appropriate folding/gluing device.

Following formation, the segmented sheets of paper are then ready for edge-deckling, at 10, as will be described more fully below. Subsequent to edge-deckling, finished sheets 11 having deckled longitudinal edges 12 are discharged for subsequent processing, as desired.

Figure 2:
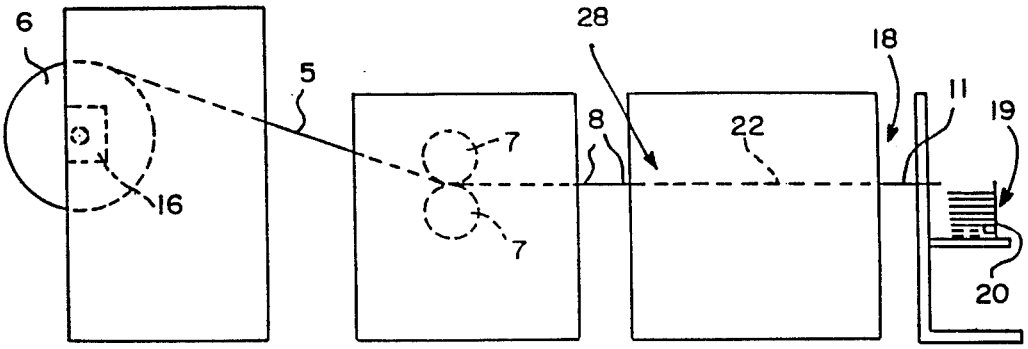
FIG. 2 is a schematic representation of an apparatus for accomplishing the deckle-edge-simulating process illustrated in FIG. 1.

FIG. 2 generally illustrates a sequence of devices for accomplishing such a procedure, as follows.

An unwinding apparatus 15 is provided to receive the roll 6 which carries the web of paper 5 and for unwinding the web 5 from the roll 6 in controlled fashion. To this end, a drive mechanism 16 is provided to engage the roll 6, and to rotate the roll 6 at a controlled speed which may be regulated in any of a variety of ways. From the unwinding apparatus 15, the web 5 is delivered to a sheet cutting apparatus 17. Again, any of a variety of sheet cutting devices may be used for this purpose, including rotary-type cutting devices (e.g., a Bowe cutter) and guillotine-type cutting devices. As previously indicated, by altering the configuration of the sheet cutting apparatus 17, it is possible to develop either segmented sheets of paper, or segmented blanks, for subsequent processing as desired to provide the required finished product.

Upon leaving the sheet cutting apparatus 17, the web of paper 5 is transformed into a series of sheets 8 having features which depend upon the configuration of the sheet cutting apparatus 17, and which are then ready for introduction to the deckle-edge-simulating apparatus 1 of the present invention, which will be described more fully below.

After proceeding through the edge-deckling apparatus 1, the finished sheets 11 are discharged from its output, at 18, for subsequent handling. In the illustrative embodiment shown in FIG. 2, this involves the delivery of finished sheets 11 to a stacking apparatus 19, which is configured to receive discrete sheets 11 discharged from the output 18 of the apparatus 1 so as to develop a stack 20 of finished sheets, for retention and baling and/or subsequent processing as desired. Any of a number of conventionally available stacking devices may be used for this purpose. Alternatively, the finished sheets 11 may be discharged from the output 18 of the apparatus 1 for direct introduction to subsequent processing machinery, such as, for example, an automatic mailer (envelope stuffer). In any event, the above-described system operates to take a continuous web of paper, and to separate the web of paper into discrete segments (sheets or blanks) having simulated deckled edges.

Figure 3:
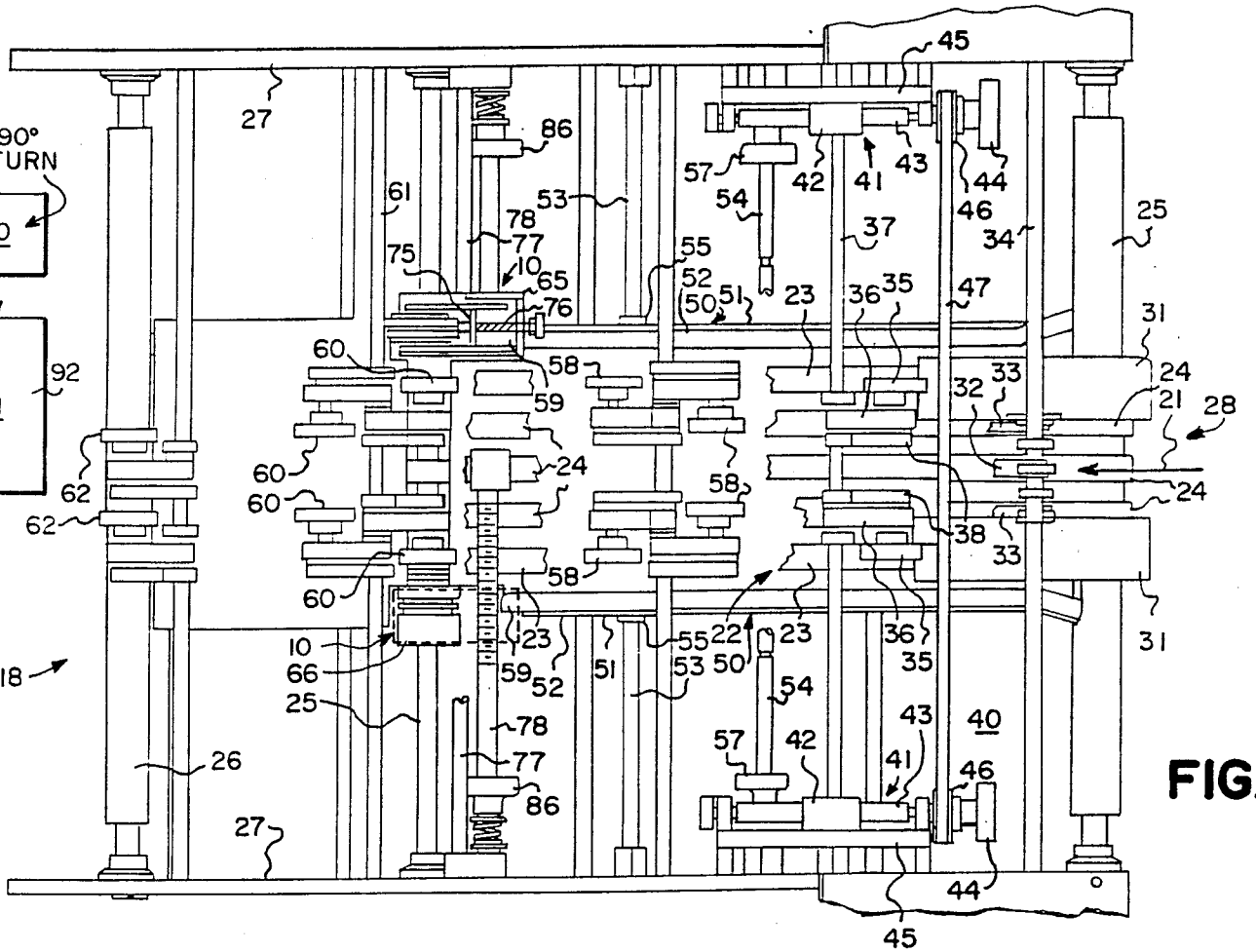
FIG. 3 is a top plan view of a preferred embodiment deckle-edge-simulating apparatus.
Figure 4:
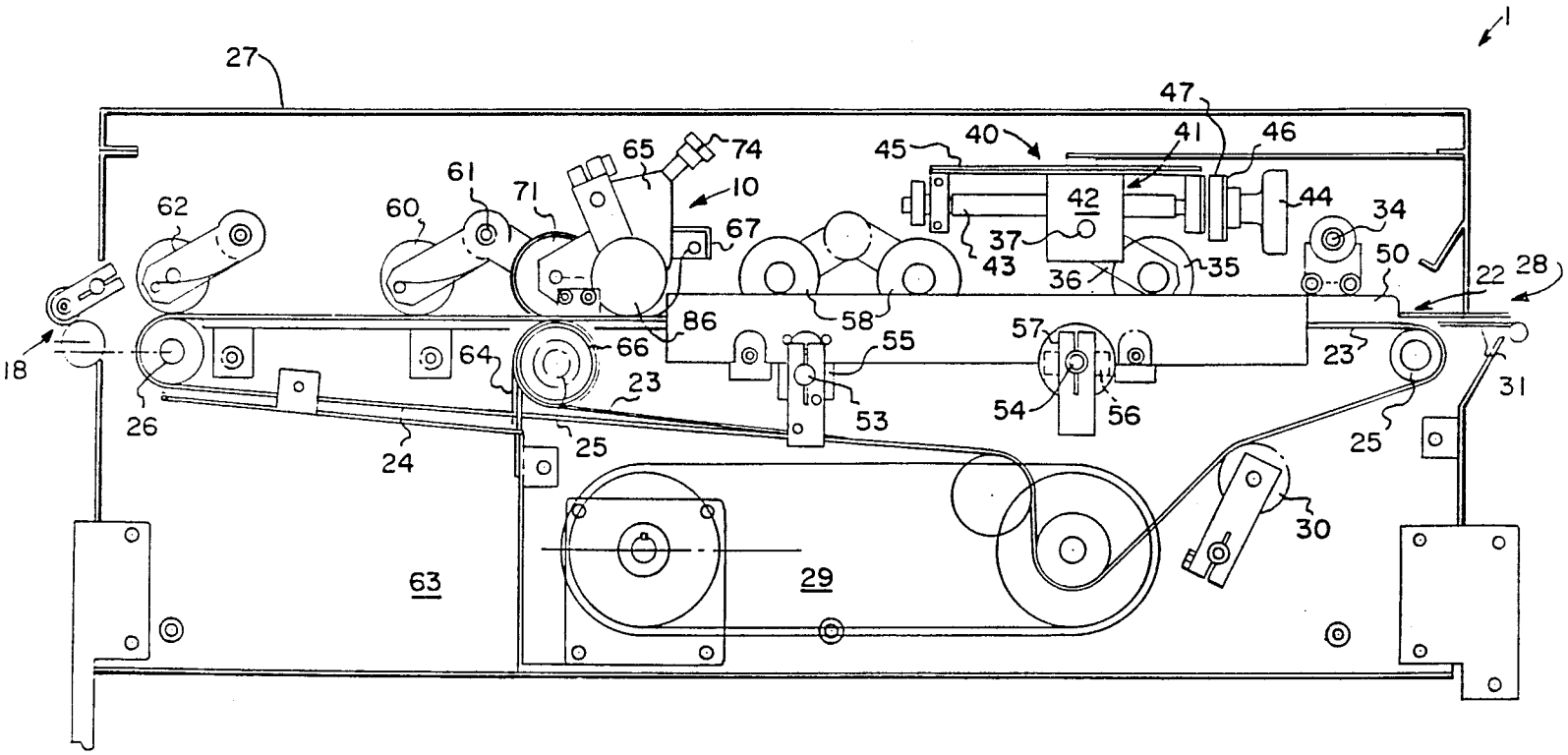
FIG. 4 is a side view of the apparatus of FIG. 3.

FIGS. 3 and 4 illustrate the deckle-edge-simulating apparatus 1 in further detail. The apparatus 1 generally operates to define a horizontally disposed web transport path 22 for receiving sheets of paper discharged from the sheet cutting apparatus 17, for subsequent edge deckling. The plane of the web transport path 22 is developed by a plurality of conveyor belts 23, 24 which extend through the apparatus 1 and over a series of support rollers 25, 26 disposed across the web transport path 22, within and between opposed framing elements 27. The conveyor belts 23 extend from the input 28 of the apparatus 1 to the deckling assemblies 10, to support edge portions of the sheets being conveyed along the transport path 22. The belts 23 are received upon the support rollers 25 so as to direct the belts 23 to an appropriate prime mover 29. A tensioner 30 is provided to assist in this set-up, and is preferably spring-loaded to account for potential stretching of the belts while in use. The conveyor belts 24 extend fully through the apparatus 1, to support the sheets as they progress through the apparatus 1 and to its output 18. The belts 24 are received upon the roller 26 so as to direct the belts 24 toward the prime mover 29 as previously described (subject to operation of the tensioner 30).

As a result, sheets of paper (or a continuous web) are capable of being received within the apparatus 1 for transport along the path 22, in the general direction of the arrow 21. These sheets will eventually encounter a pair of deckling assemblies 10 associated with the web transport path 22, which operate to create simulated deckled edges on the sheets of paper being processed through the apparatus 1 as will be described more fully below. To make sure that the deckled edges are regular and orthogonally produced, a number of devices are provided to assure correct alignment of the sheets of paper as they progress along the web transport path 22, as follows.

Sheets of paper introduced to the web transport path 22 are first encountered by a pair of paper guides 31 positioned over the conveyor belts 23, 24, and which operate to urge received sheets of paper into contact with the conveyor belts. To further assist in this process, a series of leaf springs 32, 33 extend downwardly from a support rod 34 which extends between the framing elements 29 of the apparatus 1 and over the conveyor belts 23, 24. The paper guides 31 and the leaf springs 32, 33 cooperate to properly urge sheets of paper received at the input 28 of the apparatus 1 into contact with the conveyor belts 23, 24, to reduce potential skewing and curling of the paper sheets as they are introduced into the apparatus 1. To assist in maintaining the sheets of paper in a planar configuration as they are drawn through the apparatus 1, the leaf spring 32 preferably extends fully through the apparatus 1, to its output 18. The leaf springs 33 may be terminated adjacent to the edge-deckling assemblies 10, or if desired, may continue through the remainder of the apparatus 1.

To ensure that the sheets of paper which are being received within the apparatus 1 are not interfered with, the paper guides 31 and the leaf springs 32, 33 only loosely engage each sheet of paper as it enters the input 28 of the apparatus 1. This is to prevent binding at this interface, as sheets of paper are discharged from upstream handling equipment such as the sheet cutting apparatus 17. Subsequently, steps must be taken to positively engage the sheets of paper, and to retain the engaged sheets of paper to the conveyor belts 23, 24. A pair of friction rollers 35 are provided for this purpose. Friction rollers 35 are positionable upon the conveyor belts 23, 24 (in this case the belts 23) by a pair of arms 36 which pivot downwardly from a support rod 37, and which are biased toward the transport path 22 by suitable leaf springs 38 or the like. In this fashion, paper engaging nips are developed between the friction rollers 35 and the conveyor belts 23 which are sufficient to positively transport a sheet of paper through the apparatus 1.

As previously indicated, prior to engagement by the friction rollers 35, sheets of paper must be free to enter the apparatus 1, to avoid skewing and binding at the input 28 resulting from prior operations. However, care must also be taken to securely engage the sheets of paper upon their discharge from such preceeding equipment. For this reason, the positioning of the friction rollers 35 is adjustable, according to the length of the sheets of paper which are being received within the apparatus 1.

To this end, a vernier assembly 40 receives the support rod 37 which supports the friction rollers 35. Vernier assembly 40 generally includes a pair of fixtures 41 having fixture heads 42 for receiving opposite ends of the support rod 37, and adjustment screws 43 for threaded engagement of the fixture heads 42. Rotation of the adjustment screws 43 causes longitudinal reciprocation of the support rod 37, and the friction rollers 35 which it supports, along the web transport path 22. Adjustment of the positioning of the friction rollers 35 is therefore enabled by providing the end of one, or preferably both of the screws 43 with an adjustment knob 44. Calibrated adjustment of the friction rollers 35 is provided by positioning the fixture heads 42 along a prescribed scale 45, which is representative of the distance between the nip which is developed between the friction rollers 35 and the conveyor belts 23, and the transverse cut-line for the sheets of paper as defined by the positioning of the sheet cutting apparatus 17. Each adjustment knob 44 additionally includes a pulley 46 for engaging a belt 47 which communicates with the pulley 46 of the remaining adjustment knob 44. In this manner, rotation of either of the adjustment knobs 44 causes uniform adjustment of the fixtures 41, assuring normal adjustment of the support rod 37.

Thus, the vernier assembly 40 serves to adjust the distance between the point at which the web 5 is operated upon to develop individual sheets of paper and the point at which the sheets of paper are first positively engaged by the apparatus 1. This distance will generally correspond to the length of the sheets of paper which are being processed through the apparatus 1. In this manner, suitable adjustment is provided to obtain proper engagement of the sheets of paper, without causing skewing or binding at the input 28 of the apparatus 1.

In the course of positively engaging sheets of paper for further processing through the apparatus 1, the sheets of paper are additionally caused to proceed between a pair of edge guides 50. Edge guides 50 each include a vertical member 51 for engaging edges of the sheets of paper being processed, for alignment purposes, and a flat surface 52 for supporting the engaged edges as the sheets of paper are transported through the apparatus. Each edge guide 50 progresses from a position adjacent to the paper containing guides 31 and leaf springs 32, 33, to a point just ahead of the deckling assemblies 10. As a consequence, as sheets of paper are introduced to the apparatus 1, the sheets of paper are initially only loosely received between the edge guides 50. This permits limited adjustment (alignment) of the received sheets beneath the paper guides 31 and the leaf springs 32, 33 so that the sheets are received between the edge guides 50 with their lateral edges parallel to the edge guides 50, and with their transverse edges normal to the edge guides 50. This readies the sheets of paper for engagement by the friction rollers 35, and subsequent normal transport through the apparatus 1.

To enable lateral adjustment of the edge guides 50, so as to properly receive sheets of paper within the apparatus 1, each of the edge guides 50 are slidingly received upon a pair of support rods 53, 54. To this end, bearings 55, 56 extend from beneath the flat surface 52 of each edge guide 50, for engaging the support rods 53, 54. The bearings 55 are configured to slidingly receive the support rod 53, while the bearings 56 are threaded to receive threaded support rods 54. Each of the threaded support rods 54 are separately provided with an adjustment knob 57 so that rotation of the support rods 54 causes desired lateral (inward and outward) movement of the edge guides 50. Cooperation between the support rods 53, 54 serves to assure uniform lateral adjustment of the edge guides 50, i.e., so that the distance between the edge guides 50 is uniformly maintained along their lengths.

The foregoing structures serve to positively engage sheets of paper, and to transport the engaged sheets of paper in guided fashion through the apparatus 1 and to the deckling assemblies 10. Additional idler rollers 58, which are similar in construction to the friction rollers 35, may be provided along the web transport path 22, as desired, to assure positive and normal transport of the sheets of paper to the deckling assemblies 10, for edge treatment according to the present invention. To this end, the deckling assemblies 10 are provided immediately beyond the ends 59 of the edge guides 50, inboard from the vertical members 51. In this fashion, sheets of paper are delivered to the deckling assemblies 10 in known orientation, permitting selected edges of the sheets of paper to be provided with a deckled finish as desired. In the event that the web of paper 5 is watermarked, it is even possible for the deckling assemblies 10 to be aligned with longitudinal watermarks on the web so that edge-deckling occurs along the watermark, still further enhancing the appearance of the finished product.

During edge-deckling, steps should be taken to positively draw the sheets of paper through and beyond the deckling assemblies 10 so that the sheets of paper are provided with the desired finish fully along their length. For this reason, additional idler rollers 60 which are similar in construction and purpose to the idler rollers 58, are preferably provided both adjacent to and downstream from the deckling assemblies 10 to receive and positively engage the sheets of paper as they proceed across the deckling assemblies 10 and through the remainder of the apparatus 1. The idler rollers 60 are conveniently extended from a common support rod 61. Such placement of the idler rollers 60 is preferred to make sure that the paper is maintained in the plane of the web transport path 22 a the deckling procedure takes place. However, it is to be understood that placement of the idler rollers 60 may be varied to suit particular applications, and to otherwise take whatever steps are necessary to positively and properly draw sheets of paper through the apparatus 1 as previously described.

Subsequently, the sheets of deckle-edged paper are discharged from the idler rollers 60, passing beneath a pair of friction rollers 62 located above the rearmost support roller 26. The friction rollers 62 therefore serve to positively engage the sheets of paper which are being discharged from the deckling assemblies 10, as well as to positively deliver deckle-edged sheets of paper from the apparatus 1, for subsequent handling as desired. The severed portions removed from the sheets of deckle-edged paper are preferably discharged into a collecting area 63 located beneath the apparatus 1. This is advantageously accomplished with the assistance of appropriately shaped paper guides 64 positioned to receive such severed portions from the deckling assemblies 10. To verify that the sheets of paper are properly passing through the deckling assemblies 10, means are preferably provided to detect misfed items (jams), such as the microswitch detector 67 which is shown in FIG. 4.

Figure 5:
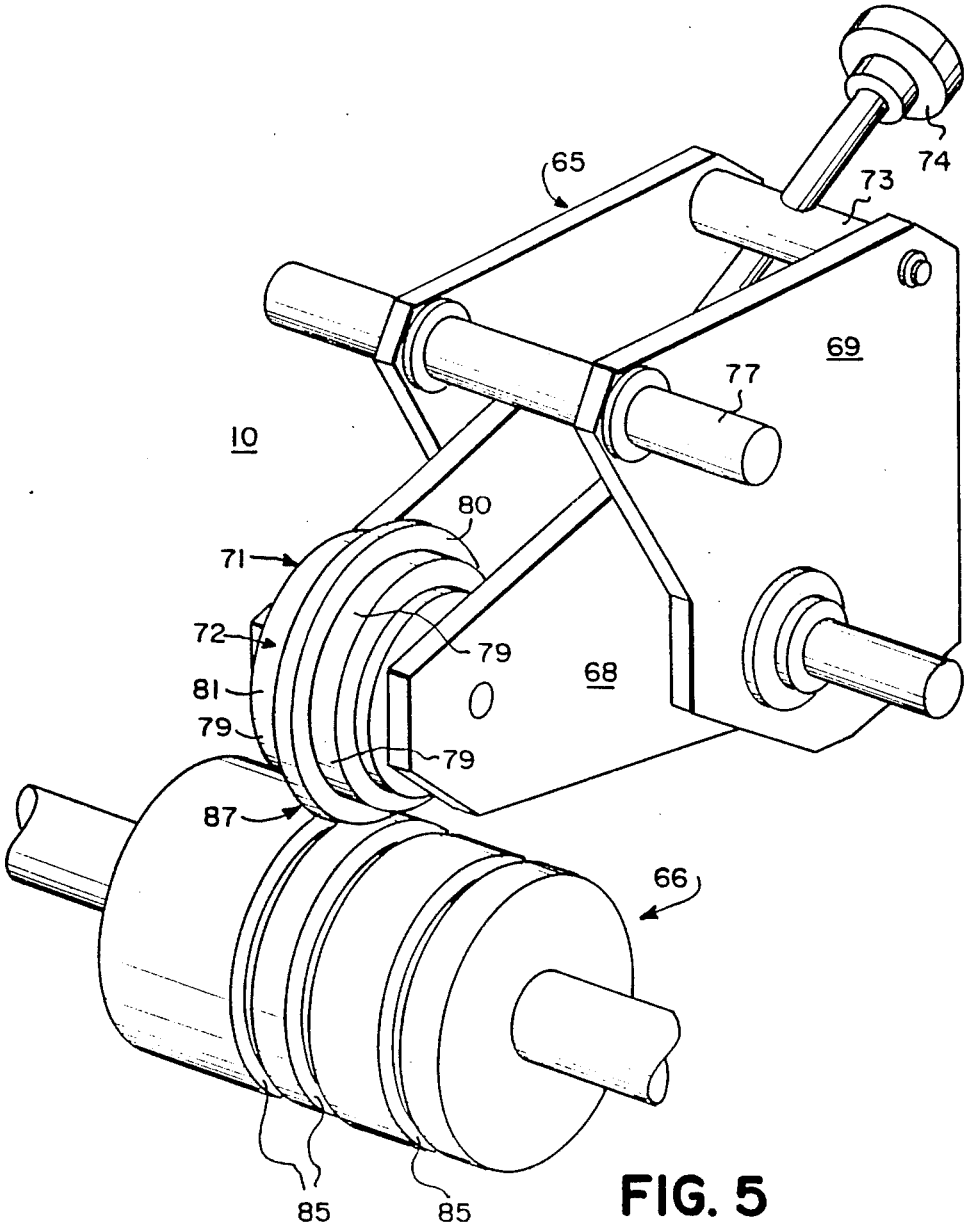
FIG. 5 is an enlarged, isometric view of the deckle-edge-simulating assembly of the apparatus of FIGS. 3 and 4.
Figure 7:
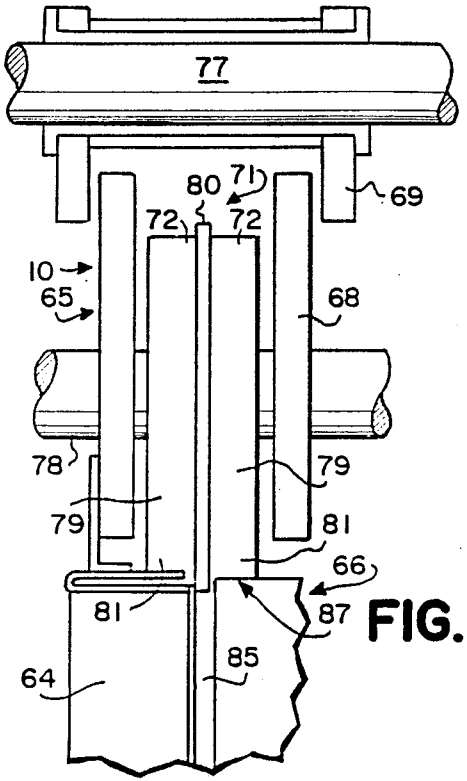
FIG. 7 is an end view of the deckle-edge-simulating assembly of FIG. 5, taken from the rear of the assembly.

Having generally described a platform for edge-deckling according to the present invention, the deckling assemblies 10 and their manner of operation to simulate a deckled edge will now be described in further detail with reference to FIGS. 5–7. Deckle-edge-simulation according to the present invention is accomplished through cooperation between a deckling fixture 65 and an opposed, cooperating roller or anvil 66. The anvil 66 is coaxial with the rearmost of the support rollers 28 which receive the conveyor belts 23, 24 as previously described. The deckling fixture 65 is positioned over the web transport path 22 so as to interact with the anvil 66. Referring to FIG. 4 of the drawings, one of the deckling fixtures 65 is shown in position over the anvil 66, while the remaining deckling fixture 65 is removed to reveal the structure of the anvil 66.

The deckling fixture 65 is generally comprised of a pair of frames 68, 69 which are pivotally connected to one another at 70. Fixture frame 68 is configured to receive a deckling roller 71, which is journaled for rotation within the frame 68 so that the periphery 72 of the roller 71 extends from beyond the frame 68. The fixture frame 69 receives a bearing 73 which in turn receives a threaded knob 74, the terminating end 75 of which engages portions of the fixture frame 68. A spring 76 is provided to bias the frames 68, 69 so that the frame 68 is urged in a generally clockwise direction (as viewed in FIG. 5) with respect to the frame 69, which is fixed in position by support rods 77, 78. Consequently, rotation of the knob 74 may be used to regulate the positioning of the frame 68, and accordingly, the roller 71, for adjustment purposes.

The deckling roller 71 is preferably comprised of a pair of roller sections 79 positioned on opposite sides of a deckling blade 80 The periphery 81 of each of the roller sections 79 is preferably provided with a frictional surface (e.g., an abrasion resistant rubber) to positively engage sheets of paper as will be described more fully below. This may be accomplished using a solid, resilient roller (e.g., nitrile rubber), or if desired, a resilient surface applied to a rigid core. Although the shape of the deckling blade 80 may be varied, it is important to select a periphery having a blunt shape, such as the preferred semi-circular cross-section which is illustrated in the drawings, as distinguished from relatively sharp structures. This has been found to enhance the bursting of fibers, to achieve a more attractive simulated deckled edge.

The deckling roller 71 is adapted to cooperate with the anvil 66 to create the simulated deckled edge of the present invention. To this end, one or more grooves 85 are provided in the anvil 66, to receive the deckling blade 80. It will be noted that the anvil 66 has a series of circumferential grooves 85 disposed along its surface. The purpose of this is to permit the apparatus 1 be adjusted to accommodate different sized papers, as well as different sized blanks, according to the intended use of the apparatus.

Adjustment of the positioning of the deckling roller 71 with respect to the anvil 66 is accomplished with a pair of adjustment knobs 86, one of which is associated with each of the respective fixtures 65. The adjustment knobs 86 are each received by a threaded support rod 78 which operates to engage the deckling fixture 65. The remaining support rod 77 operates to slidingly receive the deckling fixture 65. Rotation of the adjustment knob 86 therefore serves to laterally adjust the positioning of the associated deckling fixture 65 over the grooves 85 of the anvil 66. The adjustment knobs 86 also serve to permit adjustment of the deckling procedure as will be discussed more fully below.

Figure 6:
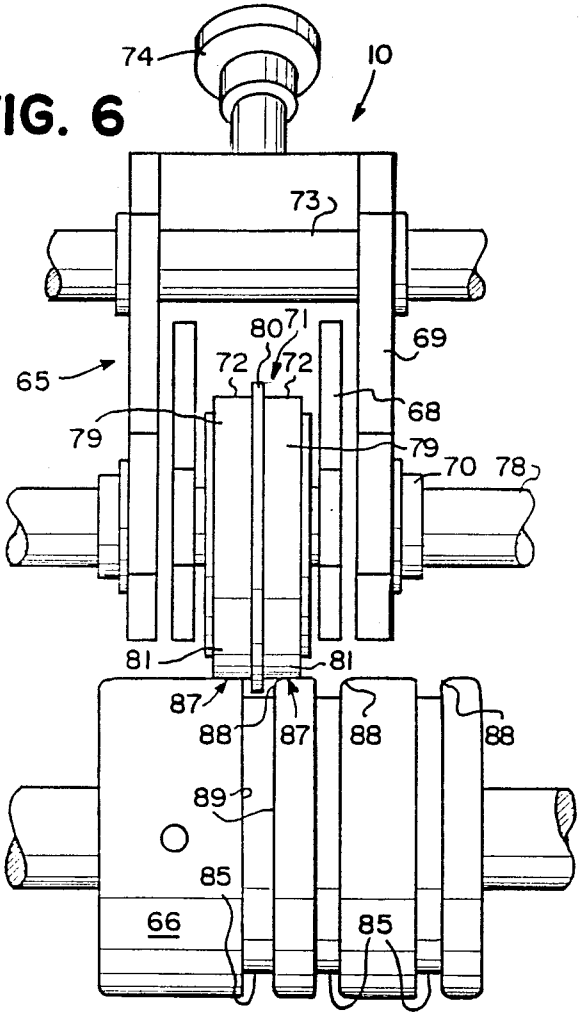
FIG. 6 is an end view of the deckle-edge-simulating assembly of FIG. 5, taken from the front of the assembly.

Referring to FIG. 6, it is seen that the deckling roller 71 and the anvil 66 combine to develop a pair of nips 87 for receiving a sheet of paper and for delivering the sheet of paper through the deckling assembly 10. The blade 80 is received within one of the grooves 85 of the anvil 66, creating a blunt protrusion extending from the plane of the nips 87. As a result of this structure, a sheet of paper passing through the nips 87 will be pinched between the roller sections 79 of the deckling roller 71 and the surface of the anvil 66, keeping the sheet of paper taught while the blade 80 displaces the paper into the selected groove 85 of the anvil 66. This displacement causes bursting of the fibers of the paper, creating the desired deckled edge. To avoid crimping of the deckled edge created in this process, the inboard corners 88 of the grooves 85 are each rounded as shown, to avoid bending (crimping) of the paper edges as the edges are drawn between the deckling roller 71 and the anvil 66.

Lateral adjustment of the blade 80 within the groove 85 may be used to regulate the fineness or coarseness of the deckled edge, with the coarser deckled edges occurring when the blade 80 is centered within the groove 85, and with the finer deckled edges (virtually a cut edge) occurring when the blade 80 lies adjacent to either of the vertical faces 89 of the groove 85. Adjustment of the positioning of the blade 80 within its selected groove 85 is accomplished by the adjustment knob 86, while adjustment of the tension at the nips 87 is accomplished by the adjustment knob 74.

It will therefore be seen that the foregoing apparatus serves to create a simulated deckled edge on sheets of paper which are capable of initially being withdrawn from a continuous roll. Because the deckling mechanism is in essence a pair of rollers, wear is kept to a minimum. Because of its simplicity, adjustment and servicing of the system is kept to a minimum. Adjustment is essentially limited to set-up and only minimal periodic checking for quality. Servicing is minimized since the deckling roller 71 and the deckling blade 80, as well as the anvil 66, exhibit only minimal wear. Accordingly, automated edge deckling is accomplished in a simplified and straightforward manner. While the apparatus of the present invention serves well to satisfy each of the objectives previously set forth, it is to be understood that such an apparatus is capable of variation without departing from the spirit and scope of the present invention.

For example, the various mechanisms which are used to transport paper through the apparatus, and to align the paper as it traverses the web transport path 22, may be varied as desired. More or fewer conveyor belts may be used. If desired, the plural conveyor belts shown in the drawings may be substituted with a single, wide conveyor belt. Retention devices such as the paper guides 31, the leaf springs 32, 33, and the idler rollers 58, 60, may be deleted or added as needed to effectively transport paper through the apparatus. Also capable of variation are the edge guides 50, and the adjustment mechanisms which are used to position the edge guides 50, the support rod 37 which receives the friction rollers 35, and the deckling assemblies 10.

Also capable of variation, as previously indicated, are the configurations for the blade 80 of the deckling roller 71 and the grooves 85 of the anvil 66. However, in this regard it is preferred that the deckling blade 80 include a blunt peripheral surface, rather than a sharp surface, since blunt surfaces have been found to be preferable in creating a feathered edge which takes on the appearance of a deckled edge.

Figure 8:
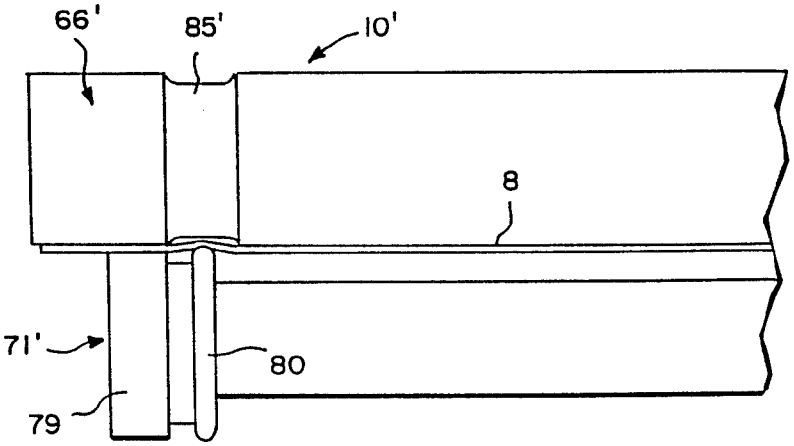
FIG. 8 is a partial, end view of an alternative embodiment deckle-edge-simulating assembly according to the present invention.

Also capable of variation is the configuration of the deckling roller 71. As previously indicated, the deckling roller 71 may be formed of a rigid material, although a resilient, abrasion-resistant surface is generally preferred. This may be provided by covering a rigid core with a resilient material, or by forming the roller entirely of a resilient material. The manner in which the blade 80 and roller sections 79 combine to develop the deckling roller 71 may also be varied. One such example of this is shown in FIG. 8, which illustrates a deckling roller 71' having only a single roller section 79, and an inboard deckling blade 80. In connection with such an embodiment, the sheet of paper 8 is held between opposing roller sections 79 located on either side of the sheet of paper, so that the inboard blades 80 can operate to develop simulated, longitudinal, deckled edges according to the present invention.

Also capable of variation is the paper-supporting platform which receives the edge-deckling assemblies 10 of the present invention. For example, the platform may be modified to accommodate continuous webs of paper throughout the deckling procedure, rather than operating upon segmented sheets as previously described. Alternatively, rather than constituting an attachment for a paper-conveying system as previously described, the deckling assemblies of the present invention may also be incorporated into other types of machines, if desired, to create simulated deckled edges in conjunction with other paper handling processes (e.g., in conjunction with a printing operation, in conjunction with operations for forming simulated watermarks, in conjunction with folding/gluing operations of the type used in envelope manufacture and automatic mailing-/envelope stuffing applications, etc).

Figure 9:
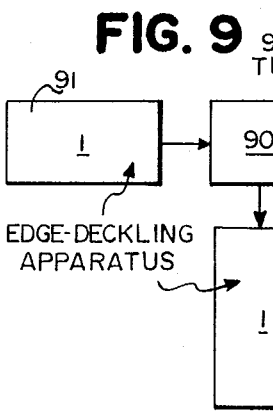
FIG. 9 is a schematic view of a deckle-edge-simulating apparatus for deckling four edges of a sheet of paper.

Lastly, it is to be noted that the foregoing describes various means for simultaneously (or separately) deckling longitudinally extending edges of a sheet of paper, leaving the transverse edges of the sheet of paper with cut edges. Referring to FIG. 9, the remaining edges may also be deckled according to the present invention by turning the sheet of paper by 90°, at 90, so that the remaining edges may be subjected to a similar edge-deckling procedure, either using the apparatus of FIGS. 1–7, or the alternative embodiment apparatus of FIG. 8. This may be accomplished in a single apparatus, or as shown in FIG. 9 using, separate devices, as desired.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for producing a deckled edge on a sheet of paper and comprising a pair of rollers contacting each other, at least one of said rollers having a resilient, abrasion-resistant surface to develop a paper-engaging nip for engaging the sheet of paper and for keeping the sheet of paper taut as it passes between said pair of rollers, wherein a first of said rollers includes a circumferential groove and a second of said rollers includes a blade having a dull-edges periphery which is semi-circular in cross-section projecting radially form the surface of said second roller and into the groove of said first roller, and wherein said sheet of paper is engaged by said nip so that as said rollers are rotated, portions of said sheet of paper are displaced into the groove of said first roller by the blade of said second roller, bursting fibers of said sheet of paper and simulating said deckled edge.

2. The apparatus of claim 1 wherein said first roller includes a plurality of grooves spaced along the surface of said first roller.

3. The apparatus of claim 2 wherein said second roller is laterally adjustable with respect to said first roller.

4. The apparatus of claim 3 wherein said second roller is laterally adjustable to align with different ones of said plurality of grooves.

5. The apparatus of claim 3 wherein said second roller is laterally adjustable to adjust the location of said blade within one of said plurality of grooves.

6. The apparatus of claim 5 wherein said adjusting varies the coarseness of said deckled edge.

7. The apparatus of claim 1 wherein said groove has an outer corner facing the deckled edge of said sheet of paper, and wherein said outer corner is rounded.

8. The apparatus of claim 1 wherein said second roller is formed of a nitrile rubber.

9. The apparatus of claim 1 wherein said blade projects from center portions of said second roller so that edge portions of said second roller form a pair of paper engaging nips with said first roller.

10. The apparatus of claim 1 wherein said apparatus includes means for adjusting tensioning at said paper-engaging nip.

11. The apparatus of claim 1 wherein said apparatus for producing a deckled edge attaches to a paper conveying apparatus.

12. The apparatus of claim 1 wherein said deckled edge is a longitudinally extending edge of said sheet of paper.

13. The apparatus of claim 1 wherein the circumferential groove is substantially wider than the blade.

14. An apparatus for producing a deckled edge on a sheet of paper, comprising means for conveying said sheet of paper through said apparatus, and a pair of rollers operatively associated with said conveying means and contacting each other, at least one of said rollers having a resilient, abrasion-resistant surface to develop a paper-engaging nip for engaging the sheet of paper and for keeping the sheet of paper taut as it passes between said pair of rollers, wherein a first of said rollers includes a circumferential groove and a second of said rollers includes a blade having a dull-edged periphery which is semi-circular in cross-section projecting radially from the surface of said second roller and into the groove of said first roller, and wherein said sheet of paper is engaged by said nip so that as said conveying means draws said sheet of paper through said apparatus, portions of said sheet of paper are displaced into the groove of said first roller by the blade of said second roller, bursting fibers of said sheet of paper and simulating said deckled edge.

15. The apparatus of claim 14 wherein said conveying means forms part of a paper handling apparatus.

16. The apparatus of claim 14 wherein said conveying means and said edge-deckling apparatus are combined in a stand-alone unit.

17. The apparatus of claim 14 wherein said sheet of paper is a continuous web.

18. The apparatus of claim 14 wherein said sheet of paper is segmented from a continuous web by a paper cutting apparatus.

19. The apparatus of claim 18 wherein said segmented sheet is a blank for forming an envelope.

20. The apparatus of claim 14 wherein said apparatus includes paper edge guides operatively associated with said conveying means, for guiding edges of said sheet of paper along said conveying means and to said pair of rollers.

21. The apparatus of claim 20 wherein said edge guides are laterally adjustable.

22. The apparatus of claim 14 wherein said conveying means includes means for positively engaging said sheet of paper with said conveying means.

23. The apparatus of claim 22 wherein said engaging means is an idler roller positioned in alignment with said conveying means and biased into engagement with said conveying means.

24. The apparatus of claim 23 wherein said idler roller and said conveying means cooperate to develop a paper engaging nip, and wherein the positioning of said nip is adjustable.

25. The apparatus of claim 24 wherein sad nip is longitudinally adjustable in the direction of movement of said sheet of paper.

26. The apparatus of claim 24 wherein said sheet of paper is segmented from a web of paper in a cutting means, and wherein said nip is adjusted so that the distance from said cutting means to said nip is approximately equal to the length of said segmented sheet of paper in the direction of movement of said sheet of paper.

27. The apparatus of claim 14 wherein the circumferential groove is substantially wider than the blade.

28. A process for producing a deckled edge on a sheet of paper, comprising the steps of:

providing a pair of rollers in contact with each other, at least one of said rollers having a resilient, abrasion-resistant surface to develop a paper-engaging nip, a first of said rollers having a circumferential groove and a second of said rollers having a blade with a dull-edged periphery which is semi-circular in cross-section projecting radially from the surface of said second roller and into the groove of said first roller;

passing said sheet of paper through said nip, engaging portions of said sheet of paper between said rollers while keeping the sheet of paper taut as it passes between said pair of rollers; and displacing other portions of said sheet of paper into said groove using said dull-edged blade, bursting fibers of said sheet of paper and simulating said deckled edge.

29. The process of claim 28 wherein said displacing bursts a longitudinally extending edge of said sheet of paper.

30. The process of claim 29 wherein paired rollers are provided on opposite sides of said sheet of paper, to simultaneously deckle longitudinally extending edges of said paper.

31. The process of claim 29 which further comprises the steps of:

rotating said sheet of paper through an angle of 90° after deckling said longitudinally extending edge; and passing said rotated sheet of paper through an edge-deckling apparatus so that a second edge of said sheet of paper, perpendicular to said longitudinally extending edge, is additionally deckled.

32. The process of claim 31 wherein paired rollers are provided on opposite sides of said sheet of paper during said edge-deckling and said additional edge-deckling, to deckle four side edges of said sheet of paper.

33. The process of claim 28 wherein portions of said second roller are provided on opposite sides of said blade, engaging portions of said sheet of paper in a pair of paper-engaging nips developed on opposite sides of said blade as said other portions of said sheet of paper are displaced into said groove.

* * * * *